United States Patent [19]

Bernardet et al.

[11] Patent Number: 5,008,585

[45] Date of Patent: Apr. 16, 1991

[54] VACUUM ARC SOURCES OF IONS

[75] Inventors: Henri Bernardet, Saint Michel sur Orge; Jean-Claude Pauwels, Brunoy, both of France

[73] Assignee: U.S. Philips Corporation, New York, N.Y.

[21] Appl. No.: 223,465

[22] Filed: Jul. 21, 1988

[30] Foreign Application Priority Data

Jul. 22, 1987 [FR] France ..... 87 10391

[51] Int. Cl.[5] ..... H01J 27/00; H01J 27/26

[52] U.S. Cl. ..... 313/231.31; 315/111.81

[58] Field of Search ..... 313/231.31, 231.51, 313/359.1, 362.1; 315/111.11, 111.21, 111.81; 250/423 R

[56] References Cited

U.S. PATENT DOCUMENTS 4,638,210 1/1987 Jergenson ..... 315/111.81 X 4,687,938 8/1987 Tamura et al. ..... 315/111.81 X 4,774,413 9/1988 Okubo et al. ..... 315/111.81 X

*Primary Examiner*—Sandra L. O'Shea

*Attorney, Agent, or Firm*—Paul R. Miller

[57] ABSTRACT

A vacuum arc source of ions of metals utilizing the principle of forming anode spots, whose anode surface (8) is fed with liquid metal (7) originating from a reservoir (6) through a connection member (9). The connection member is preferably constituted by a material chosen so that it has with respect to the liquid metal a great difference in the temperatures required to obtain the same vapor tension. The mode of feeding through the connection member is in embodiments of the invention obtained by means of a porous material (13) or contiguous slots (14). The liquid metals can be liquid at the ambient temperature (gallium, caesium) or be liquified by heating (tin, indium).

14 Claims, 3 Drawing Sheets

Figure 3A:
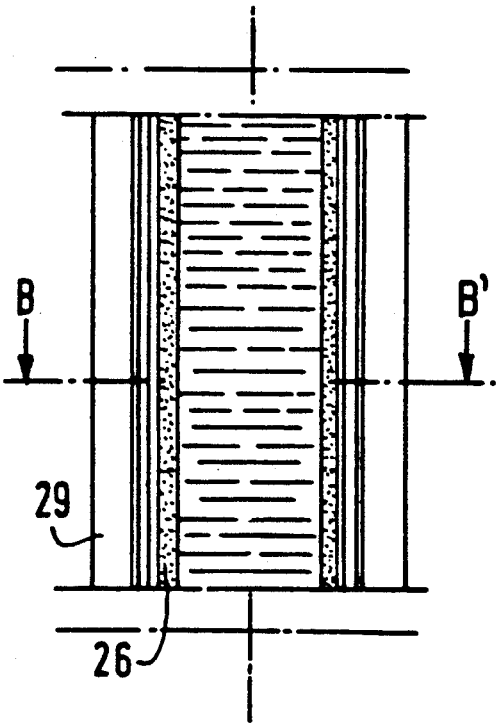

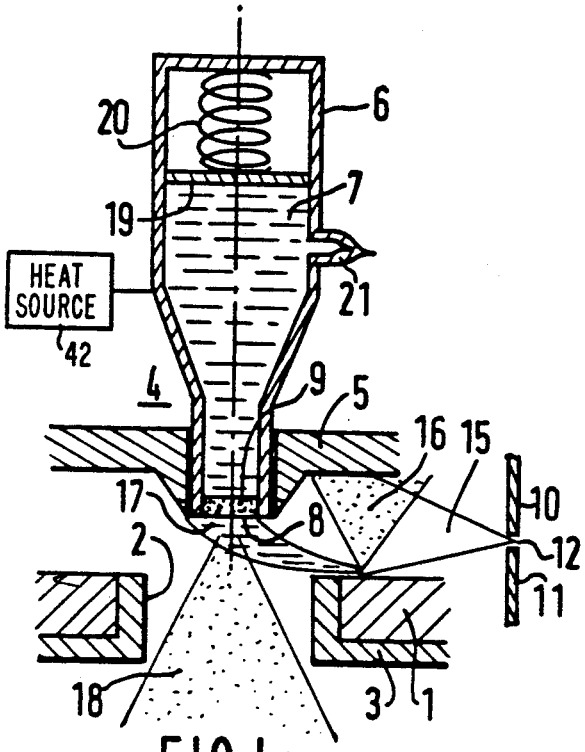
FIG. 1a
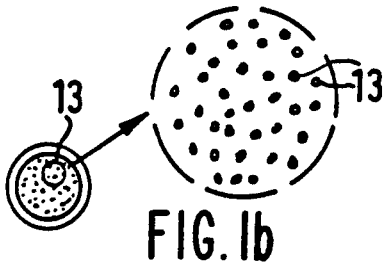
FIG. 1b
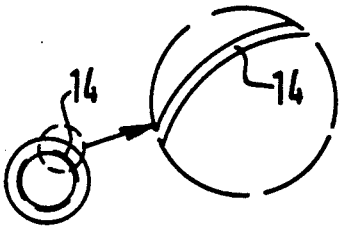
FIG. 1b'
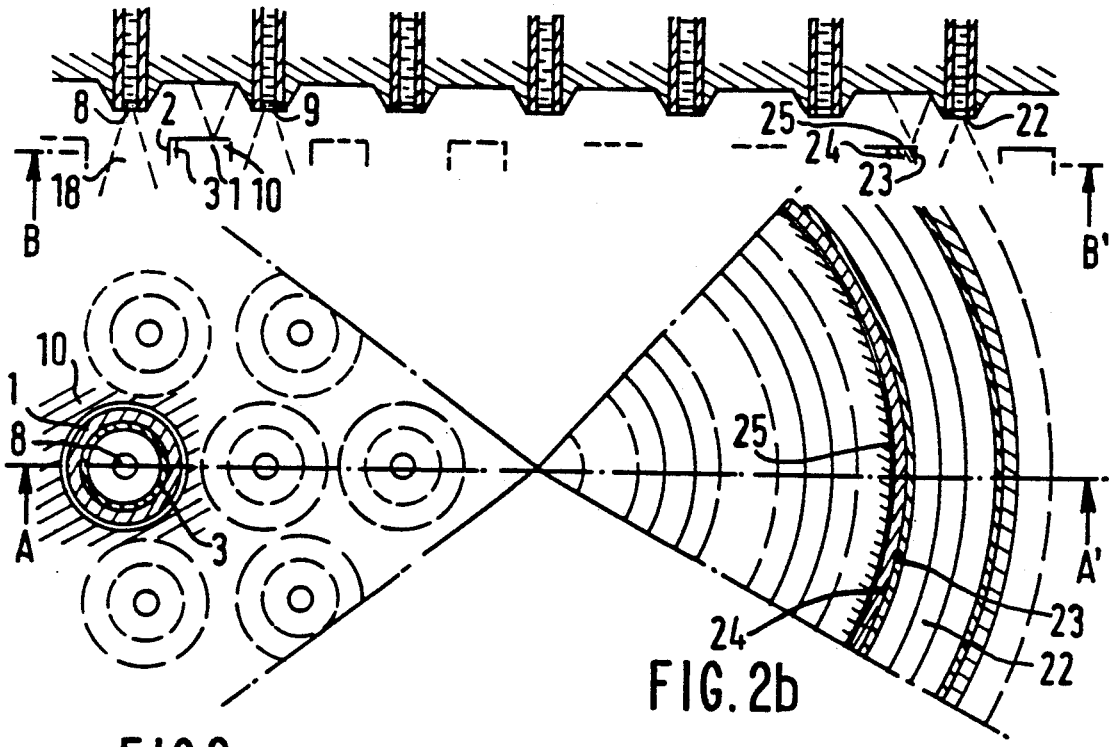
FIG. 2b
FIG. 2a

VACUUM ARC SOURCES OF IONS

The invention relates to a vacuum arc ion source comprising a cathode, a trigger electrode, an anode and means for supplying voltages to the cathode, trigger electrode and anode in such manner that a first plasma emanating from the cathode is formed between the anode and cathode, the electrons of the plasma being attracted by the anode to heat its material so that it emits a vapour and subsequently ionize the emitted vapour to form a second plasma emanating from the anode and directed towards an extraction electrode.

Ion sources are used in numerous arrangements: implantation arrangements, accelerators, neutron tubes, mass spectrometers, etc.

With respect to gas discharge ion sources, vacuum arc sources offer the possibility of reducing the pumping means between the ion source and the acceleration zone and of having available large extraction surfaces.

In an arc source of conventional configuration, the anode is an electron collector, while the cathode is an emitter of electrons and plasma (formed from the cathode material).

The reduction of the anode surface exposed to the electron flux leads to an increase of the density of the electron bombardment and hence of the energy applied.

For a threshold value depending upon the anode and cathode materials, the arc current and the exposed anode surface, this results in that luminous zones are obtained which themselves emit plasma from the anode material. The properties of these plasmas are similar to those of the cathode spots (in angle, density, speed) but the flux of the emitted substance in the form of plasma can be controlled (geometric structure, arc current, temporal characteristics of the pulses) by means of the temperature of the anode, which temperature results from the energy delivered by the electrons and the energy dissipated, more particualrly at the anode, by emission and ionisation of the vapour.

Generally the duration of use of an arc ion source is limited. Utilizing this principle of producing anode spots, the present invention has for an object to provide an arc ion source of plasma for which the duration of use is increased.

For this purpose and according to the invention the the vacuum arc ion source comprises means to supply a layer of a metal to cover the anode surface with the means comprising a reservoir for the metal and between the reservoir and the anode surface a connection member permeable to the metal.

In use the metal is vaporized and ionized at the anode surface. Metal is transferred from the reservoir through the connection member to the anode surface to compensate for losses of metal. The duration of use of the arc ion source is thereby increased.

Preferably the permeable connection member is formed from a material exhibiting with respect to the metal a great difference in the temperatures required to obtain the same vapor pressure.

The plasma will then exclusively be composed of metal ions originating from the metal layer.

Preferably the permeable connection member is disposed in such a manner that it is not obturated by deposition of cathode material.

Preferably the cathode material is chosen so that it does not disturb the wettability properties of the anode to the metal.

In a first embodiment the metal is a liquid and the connection member separating the reservoir and the anode surface is formed from a material comprising numerous pores. This permits the passage of the liquid metal by capillary effect. The material could be, for example, a frit of tungsten or nickel.

In a second embodiment the metal is a liquid and the connection member separating the reservoir and the anode surface is traversed by contiguous slots permitting the feeding of the anode surface by superficial diffusion.

Two groups of liquid metals can be used: Metals liquid at ambient temperature having a low vapour tension (gallium, caesium, gallium-indium alloy, . . . ), and metals liquifiable by heating the reservoir having a low vapour tension (tin, indium, bismuth, lead, . . .).

Another embodiment comprises means to cool the anode to low temperatures to condense the metal on the anode. This embodiment is of interest for metals having an important vapour pressure at ambient temperature (for example a few $10^{-3}$ Torr), such as mercury. The metal is condensed on the anode and is then vaporized and ionized, as metals in the liquid phase, by the electrons of the arc.

A further embodiment is characterized in that the cathode materials are considerably less refractory then the anode materials, but compatible with the wettability properties required. In order to deobturate the pores or the inlet openings of the liquid (or liquefied) metal, the ion source is caused to operate without liquid metal at higher energies permitting the forming of anode spots on the cathode material deposed on the anode. The energy on the contrary must remain below the threshold leading to anode spots on solid anode material. This (so-called conditioning) mode initiates a satisfactory operation of the ion source and prolongs the duration of use.

In order that the invention may be readily carried into effect, it will now be described more fully, by way of example, with reference to the accompanying drawings, in which:

FIG. 1*a* shows schematically a vacuum arc source of ions of liquid metals of the biplanar type according to the invention, FIGS. 1*b* and 1*b'* show sectional view of a porous anode and a slotted anode.

Figure 4A:
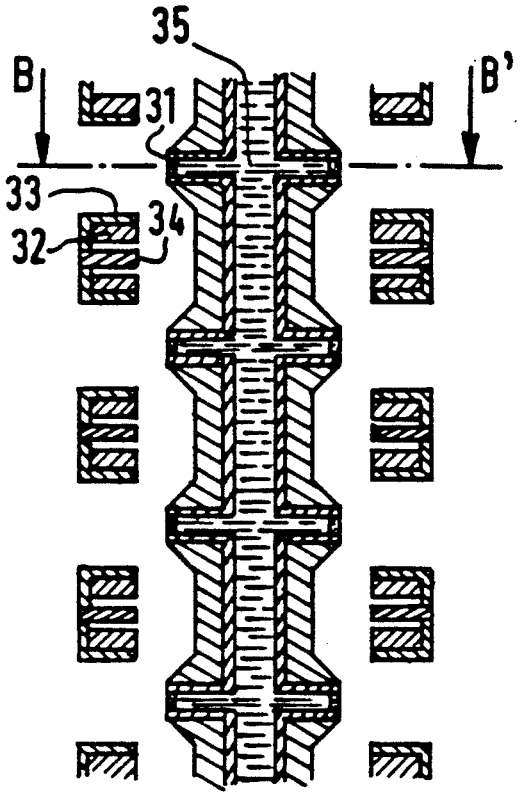
Figure 3B:
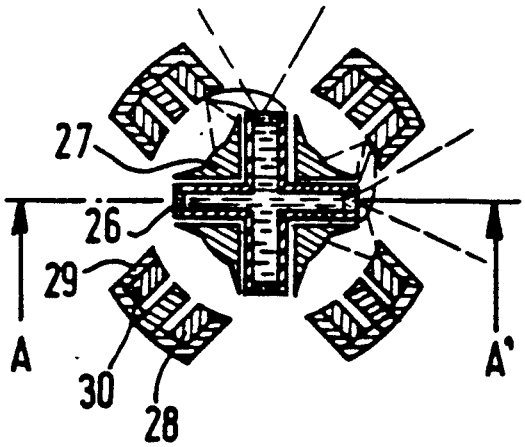
Figure 4B:
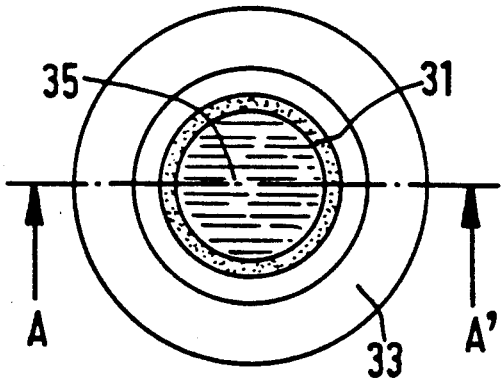
Figure 5:
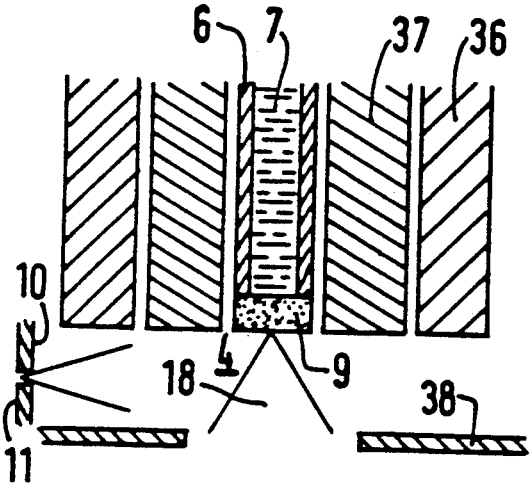
Figure 6:
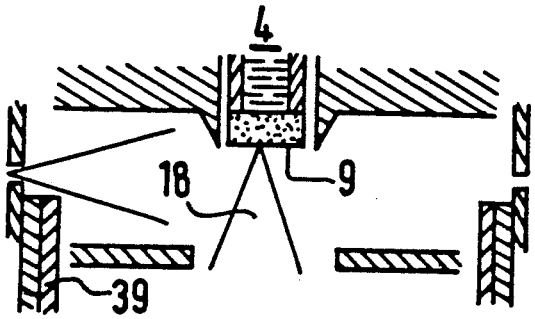
Figure 7A:
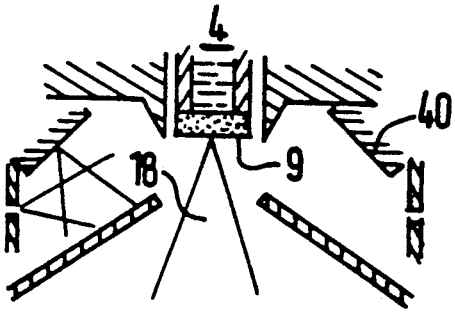
Figure 7B:
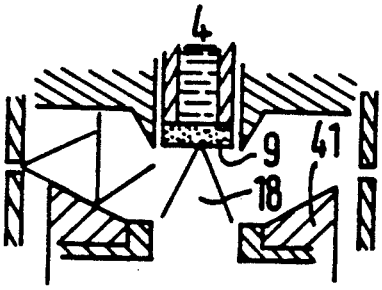

From the schematic diagram of FIG. 1*a*, various structure of plasma sources can be designed:

FIG. 2*a* shows a "multipoint" structure constituted by numerous identical elements, FIG. 2*b* shows a "ring-shaped" structure with an anode in the form of a ring and its system of a multiple of cathode spots;

FIGS. 3*a* and 3*b* show a "cylindrical" structure with the cathodes disposed along the generatrices of a cylinder;

FIGS. 4*a* and 4*b* show a "multi-annular" structure having anodes in the form of flat cylinders and cathodes disposed in the form of a ring. This structure is constituted by the parallel-combination of identical elements;

FIG. 5 shows schematically a vacuum arc ion source of ions of liquid metals of the coplanar type according to the invention;

The following source structures intermediate between the structure of the biplanar type and the sturcture of the coplanar type may also be designed:

FIG. 6 shows a structure having a cylindrical cathode;

FIGS. 7*a* and 7*b* shows structures having truncated cathodes.

Corresponding elements in these different figures are designated by the same reference numerals.

In FIG. 1*a*, a sectional view taken on a vertical plane shows a cathode of metal 1 in the form of a circular ring, whose surface facing the opening 2 is protected by an isolating screen 3.

The anode 4 is disposed so as to face the opening 2 along the axis of the ring and is held by an isolating disk 5 forming a screen and comprises according to an embodiment of the invention a reservoir 6 containing a liquid metal 7. The lower part of this reservoir has a constricted form so that it has a superficial zone 8 of small dimensions constituting the just-mentioned anode surface separated from the liquid zone of the reservoir by a wall 9.

In order to promote the ignition of an arc between the cathode and the anode, use may be made of a discharge produced between two auxiliary electrodes 10 and 11 in the form, for example, of a ring and separated from each other by a groove 12 of the order of 0.1 mm and constituting the trigger electrode. This auxiliary discharge is indispensable for the correct operation of the source; it could be obtained differently, for example, by a trigger anode gate very close to the cathode of the source.

The function of the cathode and anode screens 3 and 5, respectively, is to serve as a support for the ring 1 and for the reservoir 6, respectively, and to form a screen for the microparticles that may be released by the anode in the volume in which the ionization takes place and to shield off the cathode and the triggering electrode, which emit parasitic ions.

The wall 9 separating the liquid metal 7 from the anode surface 8 is constituted by a material comprising numerous pores 13, as shown in FIG. 1*b* illustrating a sectional view with an enlarged zone of the wall taken on a horizontal plane. Thus, the passage by capillary effect is obtained from the reservoir to the anode surface.

The mode of feeding tis anode surface can also be realized by means of contiguous slots 14 traversing the wall 9, as shown in FIG. 1*b'* also illustrating a sectional view with an enlarged zone of the wall taken on a horizontal plane. The anode surface is thus covered by superficial diffusion. The anode material chosen then depends upon its characteristics of wettability by the liquid metal.

According to the an embodiment of the invention, the wall 9 is constituted, for example, by a porous fritted system of, for example, tungsten. This frit is enclosed by the liquid metal which has diffused by capillary effect to the superficial zone 8 of the anode opposite to the opening 2.

The jets of plasma 15 and 16 emitted by the trigger electrode and the cathode, respectively, produce between cathode and anode a flux of electrons 17, which will heat in a controllable manner the part of the anode constituted by the fritted element in intimate contact with the metal element diffused.

If, for example, the metal element is gallium, the latter has a vapour tension of 1 mm of mercury at the temperature of 300° C., while the tungsten serving as support material has the same vapour tension at 4500° C.

If therefore the temperature of the anode is accurately controlled, the metal element will only be vaporized to form after ionization a jet of plasma 18 directed perpendicularly to the anode surface and exclusively composed of metal ions.

The pressure of the liquid metal in the reservoir can be fixed by a system comprising a piston 19 and a spring 20. The reservoir is provided with an exhaust tube 21, which can be replaced by a cock.

A heating system 42 can be arranged to liquefy metals that are non-liquid at the ambient temperatue.

Various structures of plasma sources can be used.

FIG. 2*a* shows a structure, in which a plurality of sources are used identical to the basic model described above. The upper part and the lower part are a vertical sectional view taken on the plane passing through AA' and a horizontal sectional view taken on the plane passing through BB', respectively, on which the cathodes 1 with their screens 3, the trigger electrodes 10, the anode surfaces 8 and the anode supports 5, the liquid metal 7 and the porous anode parts 9 are indicated.

FIG. 2*b* shows a structure with an anode in the form of a ring of small thickness. A multiring of concentric anodes 22 can thus be arranged as shown on the horizontal sectional view taken on the plane passing through BB'. Enclosing each anode, the cathode 24 and its screen 23 as well as the gate 25 are also in the form of a ring. The vertical sectional view taken on the plane passing through AA' does not differ from that shown in FIG. 2*a*.

On the structure of FIG. 3, the anodes 26 are in the form of flat parallelepipedons disposed at 90°; they are mutually separated by the screens 27. The cathodes 28 and their isolating screens 29, as well as the trigger electrodes 30 are disposed along the generatrices of a cylinder as shown on the vertical sectional view taken on the plane passing through BB'.

FIG. 4 shows a structure comprising several superimposed anodes, each of which (31) has the form of a flat cylinder. The cathodes 32 and their screens 33 as well as the trigger electrodes 34 are disposed in the form of rings which are also superimposed. A central vertical column 35 common to the anode multicylinders permits these cylinders to be fed with liquid metal, as indicated on the vertical sectional view taken on the plane AA' and on the horizontal sectional view taken on the plane BB'.

The structure shown in the preceding figures are of the biplanar type, that is to say that the anode and the cathode lie in different planes and that the cathode and anode plasmas are projected in opposite directions. An example of another so-called coplanar version is shown in FIG. 5. Similar to the biplanar version, the cathode can have the form of a circular ring 36, of which the anode 4 of small dimensions would be situated on the axis. An isolating material 37 separates the two electrodes and isolates them at voltages varying from a few kV to 20 kV.

The isolation serves also to remove the emission of the cathode spots from the axis so as to facilitate their interception by a screen 38 provided at its center with an orifice permitting the passage essentially and solely of the plasma 18 emitted by the anode spot.

The trigger electrodes gate 10, 11 required for the control may be circular and be of the same structure as in the biplanar source.

As to the functional aspect, the biplanar structure has the advantage that it can be more readily initiated (low anode-cathode voltage and trigger electrode current) because of the shorter and more direct path of the electrons.

The invention also includes all the versions of the form of cathode electrode intermediate between the so-called biplanar and the so-called coplanar structure, as shown in the diagrams of FIG. 6 illustrating a structure comprising a semi-cylindrical cathode 39 and of FIGS. *7a* and *7b* illustrating structures comprising truncated cathodes 40 and 41.

What is claimed is:

1. Vacuum arc ion comprising a cathode and an anode having a surface, means for providing a layer of liquid metal over said anode surface, said means including a reservoir of said liquid metal, a connection member disposed between said reservoir and said anode surface, and being permeable to said liquid metal, said connection member being a material having numerous pores to pass by capillary action said liquid metal from said reservoir to said anode surface;

trigger electrode means for forming a first plasma from said cathode to said anode surface, said anode surface being heated by said first plasma to form an emitted vapor of said liquid metal, and means for ionizing said emitted vapor to form a second plasma of arc ions from said anode surface and extending past said cathode.

2. Vacuum arc ion source according to claim 1, characterized in that permeable connection member is formed from a material exhibiting with respect to the metal a great difference in the temperatures required to obtain the same vapor pressure.

3. Vacuum arc ion source according to claim 1, characterized in that the permeable connection member is disposed in such a manner that it is not obturated by deposition of cathode material.

4. Vacuum arc ion source according to claim 1, characterized in that the cathode material does not disturb the wettability properties of the anode to the metal.

5. Vacuum arc ion source according to claim 1, characterized in that the connection member is a frit of tungsten or nickel.

6. Vacuum arc ion source according to claim 1, characterized in that the metal is liquid at ambient temperatures having a low vapour tension.

7. Vacuum arc ion source according to claim 6, characterized in that the metal is an element from the group consisting of gallium, ceasium and mercury.

8. Vacuum arc ion source according to claim 1, characterized in that the reservoir is supplied with heating means and the metal is liquifiable by heating the reservoir, said metal having a low vapour tension.

9. Vacuum arc ion source according to claim 8, characterized in that the metal is an element from the group consisting of tin, indium, bismuth and lead.

10. Vacuum arc ion source comprising a cathode, a trigger electrode, an anode and means for supplying voltages to said cathode, trigger electrode and anode in such manner that a first plasma emanating from said cathode is formed between said anode and cathode, the electrons of said plasma being attracted by the anode to heat its material so that it emits a vapour and subsequently ionize the emitted vapour to form a second plasma emanating from said anode and directed toward an extraction electrode, characterized in that the vacuum arc ion source comprises means to supply a layer of a metal to cover the anode surface, said means comprising a reservoir for the metal and, between the reservoir and the andode surface, a connection member permeable to the metal, and characterized in that said metal is a liquid and said connection member separating the reservoir and the anode surface is traversed by contiguous slots permitting feeding of the anode surface by superficial diffusion.

11. Vacuum arc ion source according to claim 10, characterized in that the metal is liquid at ambient temperatures having a low vapor tension.

12. Vacuum arc ion source according to claim 11, characterized in that the metal is an element from the group consisting of gallium, cesium and mercury.

13. Vacuum arc ion source according to claim 10, characterized in that the reservoir is supplied with heating means and the metal is liquifiable by heating the reservoir, said metal having a low vapor tension.

14. Vacuum arc ion source according to claim 13, characterized in that the metal is an element from the group consisting of tin, indium, bismuth, and lead.

* * * * *